US005128843A

United States Patent [19]

Guritz

[11] Patent Number: 5,128,843

[45] Date of Patent: Jul. 7, 1992

[54] MULTIPURPOSE OPTICAL DISPLAY FOR ARTICULATING SURFACES

[76] Inventor: Steven P. W. Guritz, P.O. Box 10022, Portland, Oreg. 97210

[21] Appl. No.: 698,824

[22] Filed: May 13, 1991

[51] Int. Cl.[5] ..... F21L 15/08

[52] U.S. Cl. ..... 362/103; 362/108; 362/800; 362/806

[58] Field of Search ..... 362/103, 800, 108, 806, 362/811

[56] References Cited

U.S. PATENT DOCUMENTS

| | | | |
|---|---|---|---|
| 4,570,206 | 2/1986 | Deutsch | 362/103 |
| 4,602,191 | 7/1986 | Davila | 315/76 |
| 4,709,307 | 11/1987 | Branom | 362/103 |
| 4,774,434 | 9/1988 | Bennion | 362/103 |
| 4,774,642 | 9/1988 | Janko et al. | 362/103 |
| 4,875,144 | 10/1989 | Wainright | 362/103 |

*Primary Examiner*—Ira S. Lazarus

*Assistant Examiner*—Sue Hagarman

*Attorney, Agent, or Firm*—Milton S. Gerstein

[57] ABSTRACT

An optical display device capable of securing to active limbs of a body in motion whereby body movement enhances optical display thereby illumiunating the wearer for ornamental or safety purposes. The device consists of a plurality of incandescent lamps, or the like, which are coupled to four flexible strip circuit boards. Each circuit board has a translucent shield placed on, or formed over, the length of the circuit board to cover the lamps for protection from moisture, impact, and provide alternative colored illumination. Placement of the device is on each upper arm of the user with a second circuit board positioned on each portion of a person's lower arm, all electrically components are coupled together by flexible wire or conductor tape. A control circuit provides a means for energization of the lamps by use of an integrated circuit.

22 Claims, 5 Drawing Sheets

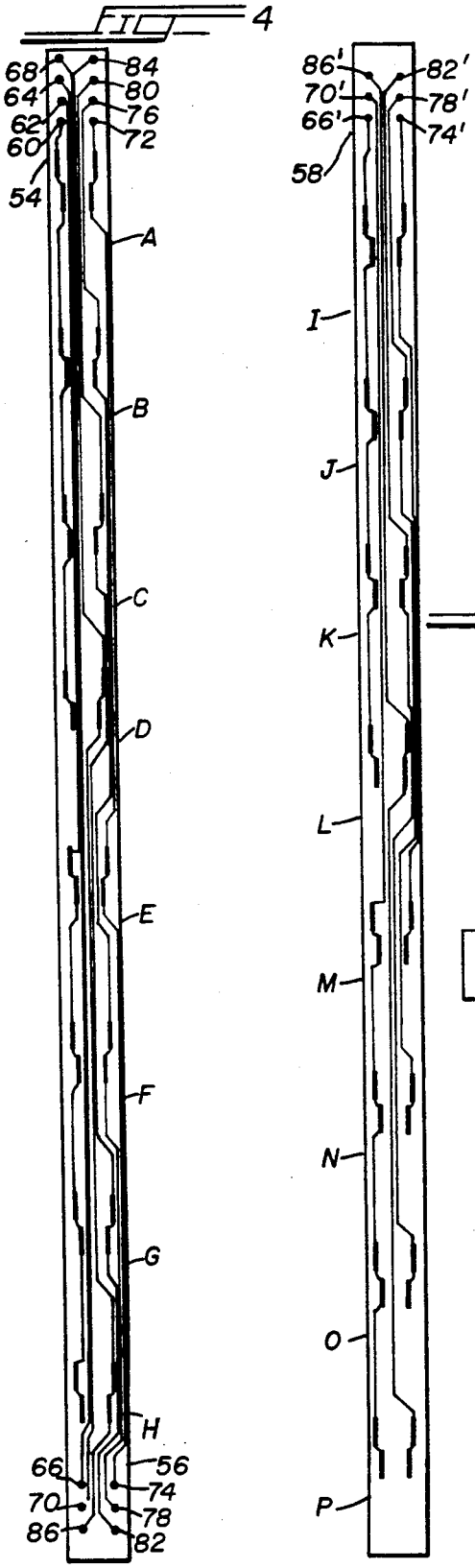
FIG 4
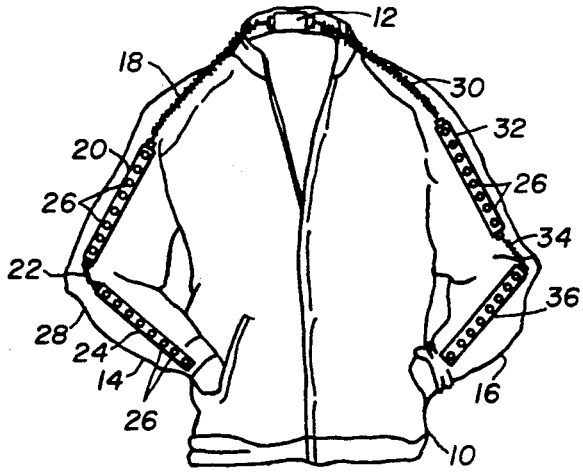
FIG 1
FIG 5
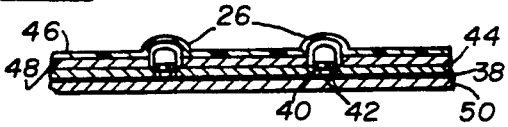
FIG 2
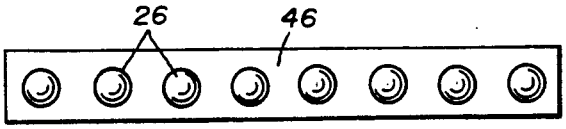
FIG 3
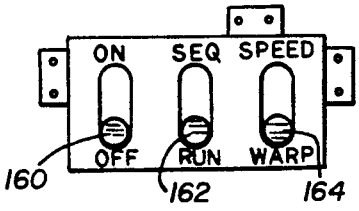
FIG 11

MULTIPURPOSE OPTICAL DISPLAY FOR ARTICULATING SURFACES

BACKGROUND OF THE INVENTION

This invention relates generally to portable optical display devices used on wearing apparel, and, more particularly, to a multi-purpose optical display device employing sealed incandescent lamps suitable for use across any flat or articulating surface found on wearing apparel.

The use of optical display devices on wearing apparel to achieve an ornamental effect is well known. Typically these devices consist of several miniaturized components such as a portable power supply, a control circuit, and the optical display. Locally mounting of the power supply allows the operator to energize the display without further need of electrical coupling. Use of a control circuit provides power management to control cyclical flashing, continuous lighting, or simply provide an interface for power distribution. Optical displays of known prior art include low current drawing components such as light emitting diodes (LED's) and miniaturized lamps.

As with any electrical application, the correct selection of electrical components is a necessity. However, use of electrical components on wearing apparel raises unique problems. For instance, electrical components located on apparel are subjected to moisture, such as chemical cleaning, and must be removed or made water resistant if the device is to remain operable. Even naturally accruing moisture may corrode connectors leading to their eventual failure. In addition, components used on wearing apparel must be lightweight, comfortable, allow freedom of movement, and look well if consumer expectations are to be met.

The prior art has only addressed the problem of moisture. For instance, is found in U.S. Pat. No. 4,570,206 by Deutsch, an optical display is releasably attached by placement of the components in a patchlike pouch. The pouch is located inside a garment requiring all display lights to be inserted through logistically placed garment openings. Before garment washing, the lights are pulled from their respectful openings and the electrical circuitry removed from the pouch. Another such device is described in U.S. Pat. No. 4,709,307 by Branom, whose optical light source is placed within a pocket formed on a garment. Yet another optical device is described in U.S. Pat. No. 4,602,191 by Davila whose optical display is placed on the inside of a jacket using a hook and loop pile fastener. All the previously mentioned devices use rigid circuit boards to hold the optical display, the circuit board is then removed before washing.

While the prior art acknowledges moisture problems, the art does not address the remaining previously mentioned problems. Further, by use of rigid circuit board circuitry and requiring logistically placed light hole openings, said devices create multiple garment manufacturing problems.

Yet another problem with known prior art is that physical constraints imposed by rigid circuitry limits component placement to portions of a garment not susceptible to consumer discomfort. For example, without regard to gender, only the front and back portions of a t-shirt provide suitable locations for placement of electrical circuitry. Placement at these locations minimize discomfort for bending is minimal. However, location of a rigid circuit board across an articulating surface such as an elbow, knee, ankle, neck, etc..., is prohibitive due to stiffness associated with rigid components. Thus, circuitry is confined to certain locations which effectively limits its use to ornamental display.

No one heretofore has addressed the need for a multipurpose display device capable of operating as a safety device as well as an ornamental display. Nor has the prior art addressed a device that is water resistant, capable of placement over articulating surfaces, thin enough so as not to add bulk, or of such little weight that the consumer will not notice the circuitry when mounted on wearing apparel.

While efforts have been made toward resolving some of these problems, no satisfactory solution has heretofore been provided. My invention is specifically designed to overcome the aforementioned problems as well as meet the additional needs stated by use of a low cost, energy efficient, multipurpose optical display especially suited for articulating surfaces. It is, therefore, to the effective resolution of these needs and problems associated therewith that the present invention is directed.

SUMMARY OF THE INVENTION

The present invention is a highly effective optical lighting display device designed to fulfill the peculiar and special requirements of optical lighting when attached to wearing apparel requiring flexibility or articulation.

My multipurpose optical display has the efficacious of illuminating along the lines of wearing apparel that heretofore could not be effectively illuminated due to bending. In accordance with the invention, the optical display device is capable of securing to active limbs of a body in motion whereby body movement enhances optical display. The device consists of incandescent lamps, or the like, which are coupled to four wafer thin flexible strip circuit boards. Each circuit board utilizes eight lamps with a translucent shield placed on, or formed over, the length of the circuit board. The shield protects the lamps from moisture, impact, as well as provide a means for alternative color illumination. Lamp replacement is simplified by use of a removable shield placed over the lamps. The shield can be made of a varity of colors and design, and be changed at any time if a new or particular color combination is sought. In addition, the top of the circuit boards can be further coated with a reflective material such as a refractive foam, prismatic film or the like, for additional illumination.

Preferred placement of the device requires placement of a first flexible strip circuit board on each upper arm of the user and a second flexible strip circuit board positioned on the person's lower arm. Use of a low tack adhesive allows for releasably securement of each circuit board, while use of a high tack adhesive can be used to permanently bond the boards to wearing apparel. It should be noted that the use of adhesive in combination with a loop and pile fastener, mending the circuit board directly to the garment, or other attachment means is within the scope of this invention.

The upper and lower circuit boards are electrically coupled together by an accordion connector or other flexible connector means. Each upper circuit board is further coupled to a central control circuit by a similar connector means. The control circuit provides for energization of the lamps in a continuous, sequential, or random flasing mode with an adjustable potentiometer for variable flashing speed, stepping, random flashing, or strobe illumination by use of an integrated circuit.

By placement of my device on the arms of a consumer, the use of the optical display device is no longer limited to ornamental display purposes as the lamp location provides a heighten safety device for recreation, sporting, and professional purposes. For instance, bicyclists, skate boarders and joggers are but a few recreational sports that would benefit from having the operator highly illuminated. Police, groundsmen at airports, crossing guards are a few examples of professional uses of my device.

It should be understood that my device can be positioned on the legs, separated by the knees, or across any other tangible matter without regard to articulation where portable illumination is desired.

Accordingly, it is the primary object of the present invention to provide an aesthetically pleasing, simple, and reliable optical display device capable of transcending articulating surfaces for safety and/or ornamental display purposes.

Another object of the present invention is to provide a means of placing incandescent lighting on a moving surface for the safety of bicyclists, joggers, children, pets or any other party who ventures during dusk.

Still another object of the invention is to provide incandescent lighting using a plurality of elongate rectilinear flexible circuit boards connected by an eight wire circuit whereby four of said eight wires are parallel connected.

Yet still another object of the invention is to provide incandescent lighting using a plurality of flexible circuit boards connected by a two wire circuit in a series parallel combination.

Another objective of the invention is to provide illumination enhancement to the base of flexible circuit boards by use of a reflective material.

Yet another objective of the invention is the use of shields to enshroud the lamps wherein each shield is made from a clear or colored translucent material, capable of diffuse refraction characteristics and further allow for ease of shield exchange or removal.

Another object of the invention is to provide a integrated circuit for control of continuous, adjustable sequential and random flashing by use of conventional chips.

Another objective of the instant invention is to provide a means for releasably securing a device to wearing apparel whereby the device is readily removed for apparel cleaning.

Other objects and advantages of this invention will become apparent from the following description taken in conjunction with the accompanying drawings wherein set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

FIG. 1 is a front view of a jacket apparel with the invention mounted thereon;

FIG. 2 is a cross-sectional view of the light shield of the instant invention illustrating lamp and electrical connections thereto;

FIG. 3 is a top view illustrating light shield placement over lamp positions;

FIG. 4 is a top perspective view of the upper portion of an 8 wire flexible circuit strip;

FIG. 5 is a top perspective view of the lower portion of an eight wire flexible circuit strip;

FIG. 11 is a front view of the manual control mechanism for selection of on/off, sequential/run and speed of the light display.

DETAILED DESCRIPTION OF THE INVENTION

Figure 6:
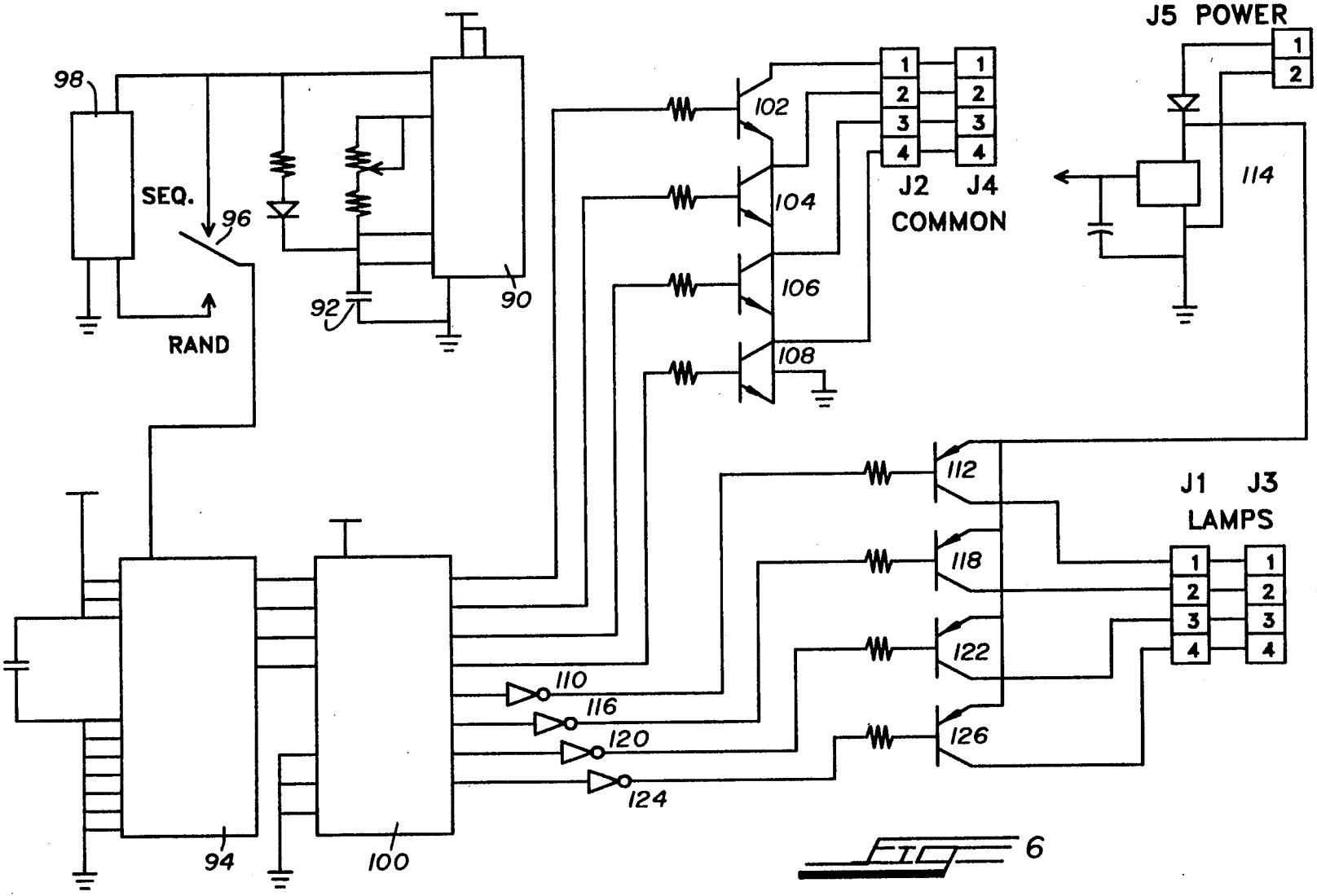
FIG. 6 is an electrical schematic of the eight wire circuitry of the invention.

As required, detailed embodiments of the present invention are disclosed herein, however, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Referring to the drawings in more detail, FIG. 1 illustrates a typical piece of wearing apparel 10 for use by a consumer on which the device is mounted. Component location is distributed for optimum effect by placement on the arms with the control circuit centrally located. Per the illustration, central control circuitry 12 is logistically located between a first bank 14 of elongated rectilinear shaped flexible circuit boards and a second bank 16 of elongated rectilinear shaped flexible circuit boards, each bank a mirror image of the opposite bank. An accordion cable 18, between eight and twelve inches long in a closed position and twelve to twenty inches in an open position, couples the control circuitry 12 to an upper circuit board 20 of the first bank. A second accordion cable 22, between one to four inches long in a closed position and three to nine inches in an open position, couples the upper circuit board 20 to a lower circuit board 24. Each circuit board contains a plurality of incandescent lamps 26, the preferred embodiment being eight incandescent lamps placed equidistantly along the length of each circuit board. Attention should be given to placement of the upper circuit board 20 in relation to the lower circuit board 24 in that each board resides on opposite sides of an articulating surface, in this instance the elbow joint 28.

The second bank 16 forms a mirror image of the first bank 14 by use of accordion cable 30 which couples the control circuitry 12 to an upper circuit board 32 of the second bank. A second accordion cable 34 couples upper circuit board 32 to lower circuit board 36. Each circuit board also contains a plurality of incandescent lamps 26 placed equidistantly along the length of each circuit board. Each circuit board on each bank being between four and twelve inches long and 1/16 to one inch in width.

Now referring to the cross sectional view of FIG. 2, miniaturized lamps 26 such as unbiased 5 volt incandescent lamps with a 0.200 mean spherical candle power (MSCP), are electrically coupled to flexible circuit board 38 by soldering or use of electrically conductive transfer adhesive tape 40 having low impedance in the thickness direction and very high impedance in the transverse direction such as 3M #9703. Use of conductive transfer adhesive tape eliminates need to solder lamps by tape placement over circuit board contacts allowing adhesive to become operatively associated to lamp leads 42. A layer of dual sided adhesive tape 44, or adhesive foam gasket, is then placed over the remaining portion of the circuit board allowing for the releasably coupling of translucent dome shaped shield 46. Shield 46 seals the lamps from moisture, damage, or accidental loosening of lamp leads. Shield 46 can be clear, colored, or have diffuse refraction characteristics. It should be noted that a flat shield, diamond shaped shield, or other conformal shape is deemed within the scope of this invention and is adjustable by use of appropriate sized adhesive 44. A reflective material 48 may be placed over the adhesive tape 44 to provide additional reflection qualities. Such a reflective material can be prismatic film, or the like, with adhesive qualities in and of itself. It should be noted that the use of LED's in place of lamps are permissible allowing shield installation by use of clear rubber coating sprayed on for a permanent finish.

Circuit board 38 is releasably secured to wearing apparel by use of pressure sensitive two sided tape or similar adhesive. Although not illustrated, another attachment means is use of high tack adhesive to permanently bond circuit boards to wearing apparel or use in combination with a loop and pile attachment. Yet another attachment means is use of holes inserted into the circuit boards allowing the boards to be sewn directly on the wearing apparel.

FIG. 3 illustrates a top view of a flexible circuit board having incandescent lamps 26 seen beneath shield 46. Lamp replacement is performed by lifting shield 46 from its adhesive attachment to access the problem lamp. Once a replacement lamp is installed, the shield 46 is simply placed back over the adhesive tape and pressed against the adhesive to create the bonding necessary for adherence. The shield can also be changed at any time for a new or different color combination by following the aforementioned procedures.

Now referring to FIG. 4, an eight wire simplified flexible circuit board 52 is shown. In this configuration the circuit board, referred to as the upper circuit board, employs a lead connector portion 54 for attachment to the control circuitry described in detail later in this description. Lead connector 60 is used to serially connect lamp positions A, B, C and D; connector 62 is used to serially connect lamp positions E, F, G and H; connector 64 is not lamp connected on the upper board and carries through to end connector 66; similarly connector 68 is not lamp connected on the upper board and carries through to end connector 70. Connector 72 is used to serially connect to lamp positions A, E, and end connector 74; connector 76 is used to serially connect to lamp positions B, F, and end connector 78; connector 80 is used to serially connect to lamp positions C, G, and end connector 82; connector 84 is used to serially connect to lamp positions D, H, and end connector 86.

The remaining six end connectors of the upper circuit board 52 are exposed in end connector portion 56 for corresponding coupling to end connectors of a lower circuit board 59. Coupling is performed by straight six wire accordion connector, not shown, The flexible accordion connector allows electrical current transfer over portions of a garment whose articulation is too severe for placement of even a flexible circuit board. The exposed contacts are copper pads with tin coating for moisture protection. For ease of assembling the accordion tape to the end connector portion, a piece of 3M #9703 electrical conductive transfer adhesive tape is placed over the end connector portion 56 of the upper circuit board 52. The flexible accordion connector is then placed over the conductive transfer adhesive tape whereby pressure sensitive adhesive physically bonds the connection and the electrically conductive particles within the conductive transfer adhesive tape to provide a direct connection between end connector portion 56 and lead connector portion 58 of the lower circuit board 59. The accordion connector further connects 86 to 86' of FIG. 5; 70 connects to 70'; 66 connects to 66'; 82 connects to 82'; 78 connects to 78'; and 74 connect to 74'.

Now referring to FIG. 5 illustrating the lower circuit board 59 of the invention, it can be found that 66' is used to serially connects to lamp positions M, N, O, and P; 70' serially connects to lamp positions I, J, K, and L; 86' is used to serially connect L and P; 82' is used to serially connect K, and O; 78' is used to serially connect J, and N; and 82' is used to serially connect I, and M.

A second bank of flexible circuit boards, not shown, is formed in mirror image to the above mentioned first bank whereby the lead connector portions of each bank are made to a centralized control circuitry.

The circuitry of the preferred embodiment suitable for controlling the eight wire flexible circuit boards of FIGS. 4 & 5, and associated lamps, is shown in FIG. 6. In this IC chip based timing circuit, a conventional 555 IC timer 90 operates in an astable operation wherein it will trigger itself and free run as a multivibrator. External capacitor 92, 0.47 mfd, charges through resistors R1 and R2 which controls the duty cycle by ratio between R1 and R2, however, variable resistor VR1 operates as a potentiometer and by placement before R1 allows the operator to vary the frequency of the IC timer 90 pulse train. The pulse train is delivered directly to counter 94 when switch 96 is set placed in the "sequential" mode or the pulse train is made random by placing switch 96 in the "random" mode whereby digital noise 5437 source 98 creates a random pulse which is then delivered to counter 94. Counter 94 is a presettable up/down counter such as 4029 which can count in binary when binary/decade is at logical 1. A logical 1 present enable signal allows information at the jam inputs to preset the counter to any state asynchronously with the clock. The counter is advanced one count at the positivegoing edge of the clock in the carry in and present enable inputs are at logical 0. The four bit output of counter 94 at Q0, Q1, Q2, & Q3 is delivered to conventional output decoder 100 such as a 4555 whereby output 9, 10, 11, 12 form a simultaneous common for the enerigization of lamps by use of 1-K OHM resistors R3, R4, R5, R6 each followed by NPN-2N4124 transistors 102, 104, 106 & 108 respectfully. The collector of each transistor is connected to the J2 and J4 common which in turn is connected to each bank of flexible circuit boards, the emitter is brought to sink. J2 terminal 1 is connected to contact 60 shown in FIG. 4; J2 terminal 2 is connected to contact 62; J2 terminal 3 is connected to contact 64; and J2 terminal 4 is connected to contact 68. J4 terminal forms a mirror image to a second upper circuit board (not shown).

Decoder 100 output 4 through 7406 inverter 110 to 1-K resistor R7 to PNP-2N4126 transistor 112 whose emitter is coupled to battery source 114 to power contacts 1 of J1 which in turn energize corresponding lamps D and H by connection to contact 84 shown on FIG. 4 and by use of contact 86 to 86' of FIG. 5 to energize corresponding lamps L and P. Stepping decoder 100 then outputs to 5 through inverter 116 to resistor R8 to PNP transistor 118 whose emitter is coupled to battery source 114 to power contacts 2 of J1 which in turn energize corresponding lamps C and G by connection to contact 80 shown on FIG. 4 and by use of contact 82 to 82' of FIG. 5 to energize corresponding lamps J and 0. Stepping decoder 100 then outputs to 6 through inverter 120 to resistor R9 to PNP transistor 122 whose emitter is coupled to battery source 114 to power contacts 3 of J1 which in turn energize corresponding lamps B and F by connection to contact 76 shown on FIG. 4 and by use of contact 78 to 78' of FIG. 5 to energize corresponding lamps J and N. Finally decoder 100 outputs to 7 through inverter 124 to resistor R10 to PNP transistor 126 whose emitter is coupled to battery source 114 to power contacts 4 of J1 which in turn energize corresponding lamps A and E by connection to contact 72 shown on FIG. 4 and by use of contact 74 to 74' of FIG. 5 to energize corresponding lamps I and M. J3 contacts are coupled to the corresponding J1 contacts for control of the second bank of flexible circuit boards and mounted lamps, not shown, in a similar fashion It should be recalled at this point that decoder 100 output is dependent upon position of sequential/random selector switch 96.

Another embodiment of the device is a two wire circuit which utilizes an IC timer and power supply mounted at a remote location with a two wire transfer to each flexible circuit board wherein a hybrid chip is locally mounted for actually control of the lamps. Now referring to FIG. 7, a two wire flexible circuit board 130 is shown. In this configuration the circuit board, referred to as the upper circuit board, employs a lead connector 132 and 134 for attachment to the two wire timer and power control circuitry described in detail later in this description. Lead connector 134 provides pulse input to the hybrid chip circuit and carries to end connector 136. Lead connector 132 serially connect common side of lamp positions AA, BB, CC, DD, EE, FF, GG, HH, and carries to end connector 138. Lamp enerigization is by individual wire to each of said lamp positions by operation of the hybrid chip described later in this embodiment.

Coupling is performed by straight two wire accordion or flexible connector, not shown. The flexible accordion connector allows electrical current transfer over portions of a garment whose articulation is too severe for placement of even a flexible circuit board. Coupling provides a direct connection between end connector portion 136 and lead connector portion 136' of the lower circuit board 140 shown in FIG. 8. The connector further connects 138 to 138'. Now referring to FIG. 8, in this configuration the circuit board 140, referred to as the lower circuit board, employs a lead connector 136' to serially connect common side of lamp positions II, JJ, KK, LL, MM, NN, OO, and PP. Lead connector 138' is from the two wire timer and power control circuitry for pulse input to the board mounted hybrid chip circuit A second bank of flexible circuit boards, not shown, forms a mirror image to the above mentioned first bank whereby the lead connector portions of each bank are made to a centralized control circuitry.

Figure 7:
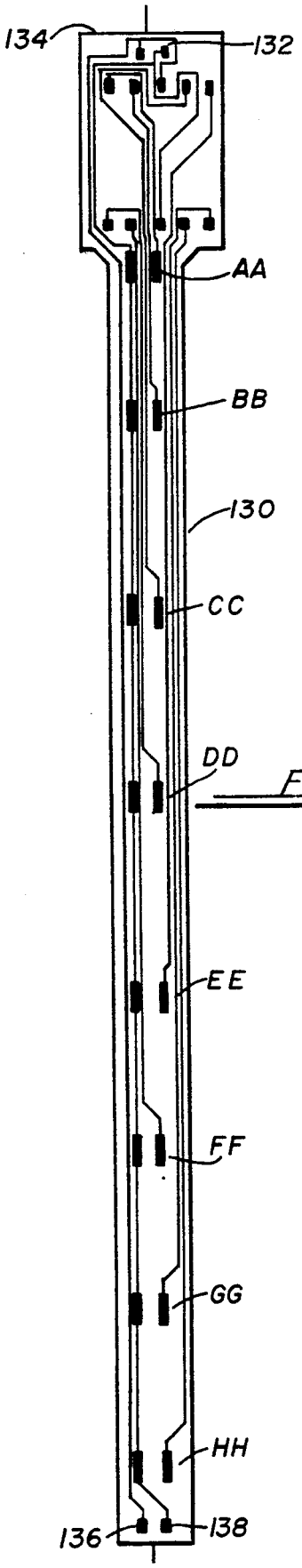
FIG. 7 is a top perspective view of the upper portion of the two wire flexible circuit strip.
Figure 8:
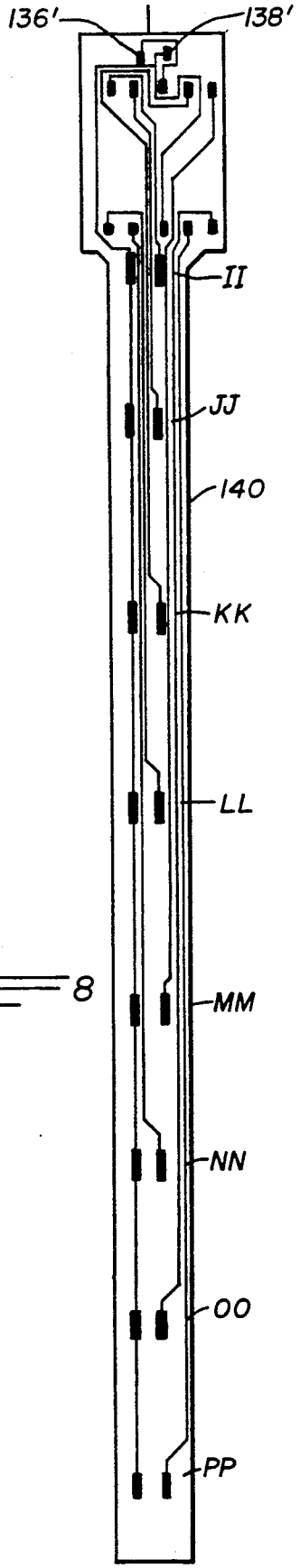
FIG. 8 is a top perspective view of the lower portion of a two wire flexible circuit strip.
Figure 9:
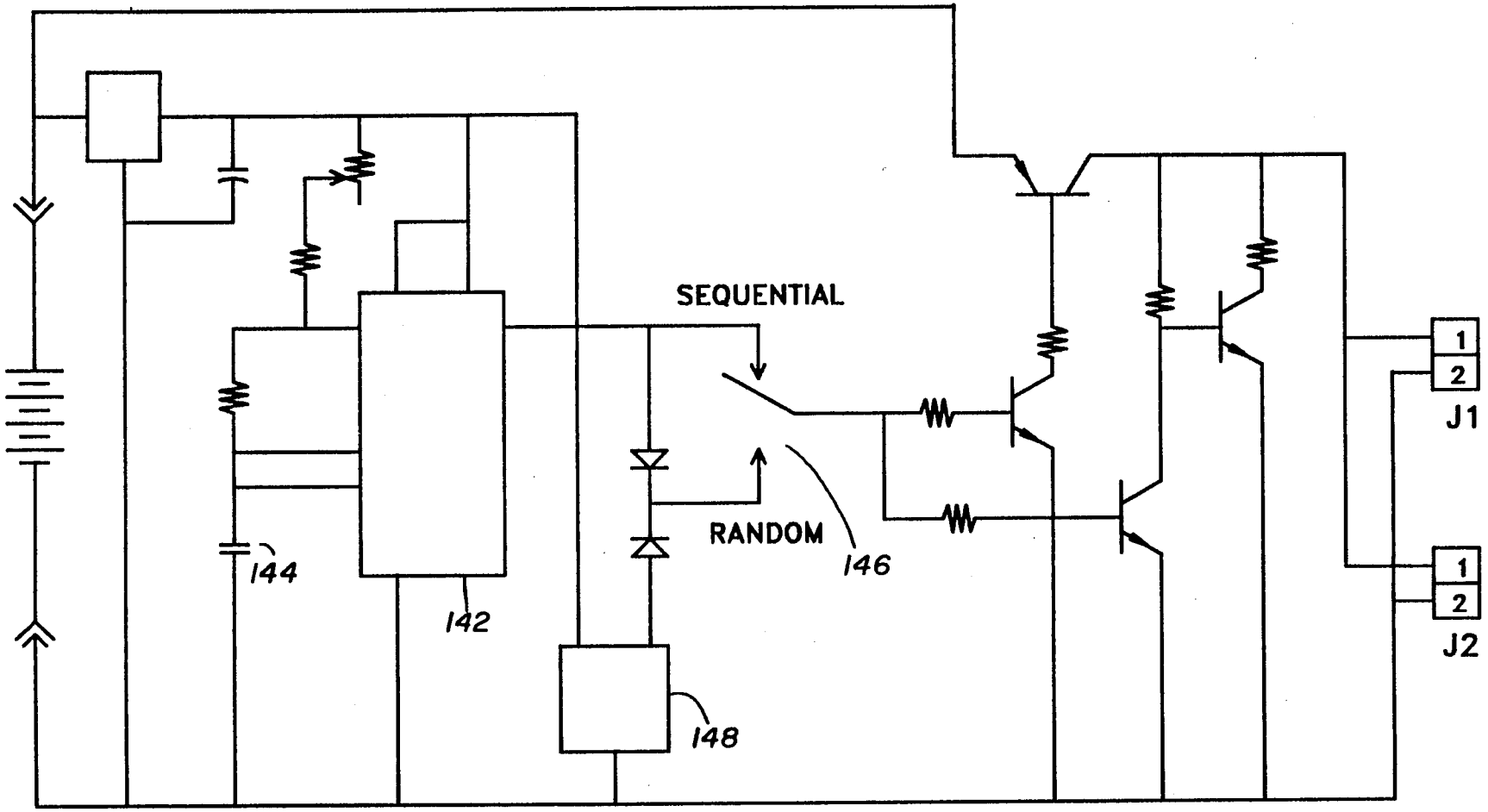
FIG. 9 is an electrical schematic of the two wire power supply circuitry of the invention.

The circuitry of the two wire suitable for pulse input of hybrid circuits for control of flexible circuit boards shown in FIGS. 7 & 8, and associated lamps, is shown in FIG. 9. In this IC chip based timing circuit, a conventional 555 IC timer 142 operates in an astable operation wherein it will trigger itself and free run as a multivibrator. External capacitor 144, 0.47 mfd, charges through resistors R1 and R2 which controls the duty cycle by ratio between R1 and R2, with variable resistor VR1 operating as a potentiometer by placement before R1 to allow the operator to vary the frequency of the IC timer 142 pulse train. The pulse train is delivered to NPN PN2222 transistor Q1 through 10K ohm resistor R3 and to NPN PN2222 transistor Q2 through 10K ohm resistor R4 when switch 146 is placed in the "sequential" mode. The pulse train is made random by placing switch 146 in the "random" mode whereby digital noise 5437 source 148 creates a random pulse in combination with D1N914 diode D1 and D1N914 diode D2 before delivery to transistors Q1 and Q2. Q1 operates in conjunction with Q4 for voltage supply to contact 1 of J1 and J2. Q2 operates in conjunction with Q3 for voltage supply to contact 2 of J1 and J2. J1 is connected to the PWR contact of FIG. 10 by use of a connector wire, not shown. J2 is connected to the GRN contact of FIG. 10 by use of a connector wire, not shown.

Figure 10:
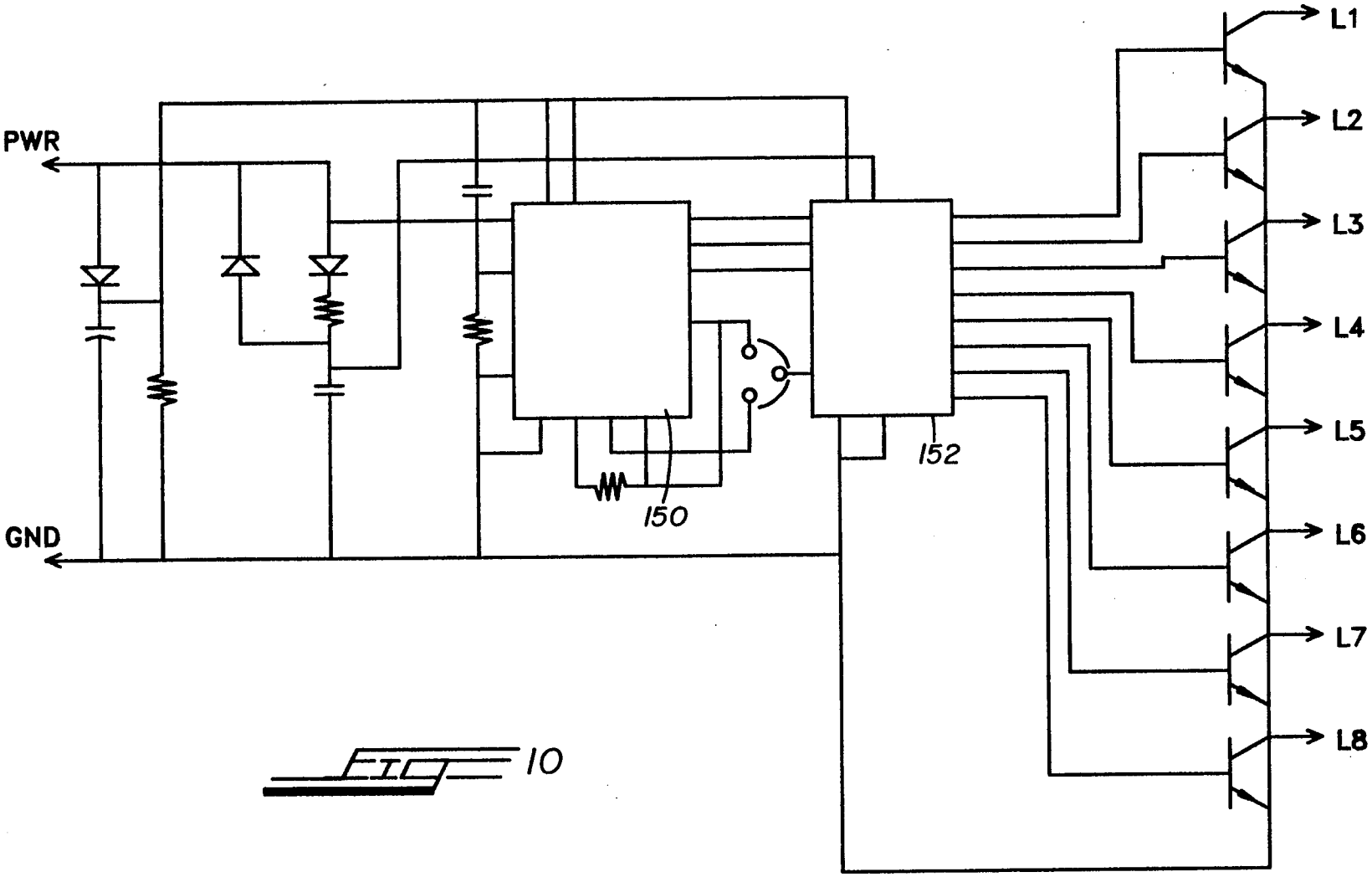
FIG. 10 is an electrical schematic of the two wire strip board mounted hybrid chip circuitry of the invention.

Now referring to FIG. 10, the control circuitry mounted on the first end of each flexible board for control of eight lamps per board. Employing a dual synchronous counter 150 as a conventional 4520 in which pulse train is delivered directly to CL pin 1; to EN pin 2 and pin 16 by after diode D1 in which capacitor C1 and resistor R2 sink to ground. Ground pin 8 and CL pin 9 are coupled to ground, RST pin 7 connected to ground by resistor R3 with voltage applied through capacitor C3. Pins 3, 4, 5 and 6 follow the 1-2-4-8 binary code with output changing state synchronously. Pin 6 is coupled to RST pin 15 for the count to reset and to EN pin 10 for advancement of the second portion of the dual counter after resistor R4, pin 6 is further connected to switch JP1. Pin 11 of the dual counter, first output of the dual counter, is also delivered to switch JP1.

The four output of the first half of the counter, or depending on JP1 switch location, the first three outputs and the first counter and the first output of the second counter, is connected to a 1-OF-8 switch 152 such as an 4051 multiplexer. Pin 7 and 8 are grounded, Pin 3 is used as an input from the power circuit after diode D1, D2 and resistor R2 with capacitor C2 to ground. Pin 16 is coupled to pin 16 of counter 150 for voltage. When INH pin 6 of switch 152 is low the channel selected is determined by the binary input from counter 150 to pin 9=C, pin 10=B, and pin 11=A, pulse signal is then distributed by pin 13=1 to transistor 2N4124 of lamp L1, pin 14=2 to transistor of lamp L2, pin 15=3 to transistor of lamp L3, pin 12=4 to transistor of lamp L4, pin 1=5 to transistor of lamp L5, pin 5=6 to transistor of lamp L6, pin 2=7 to transistor of lamp L7, and pin 4=8 to transistor of lamp L8.

The control circuit may be as complicated as that shown in first embodiment of FIG. 6, or second embodiment of FIG. 9 and 10, or it can be as simple as an on/off circuit with or without a timing mechanism.

FIG. 11 illustrates the manual control switch whereby switch 160 completes connection to the power supply, switch 162 operates switch 96 on FIG. 6, switch 146 on FIG. 9, for control of random or sequential timing. Switch 164 operates the variable resistor VR1 of FIG. 6, VR1 of FIG. 9.

It is to be understood that while we have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What I claim as new and desire to secure by Letters Patent of the United States is:

1. An optical display device for use on wearing apparel having articulating surfaces comprising:

a first bank of elongated flexible circuit boards, said first bank having an upper flexible circuit board with a first end and a second end, said first bank also having a lower flexible circuit board with a first end and a second end, each of said upper and lower circuit boards having a connector surface and an attachment surface, said second end of said upper flexible circuit board being spaced from said first end of said lower flexible circuit board in order to provide a space therebetween which is to be associated with an articulated surface portion of a garment, or the like, to which said first bank is supported;

a first plurality of illumination means electrically connected on said connector surface of each of said upper an lower flexible circuit boards of said firs bank;

shield means coupling to said connector surface between said first and second ends of each of the upper and lower circuit boards of said first bank, said shield means enshrouding said illuminating means for forming a barrier thereto;

control circuitry for the energization of said illumination means, said control circuitry comprising a semi-flexible circuit board having IC chip based timing circuit, and having a power surface for illuminating said illumination means;

connector means electrically connecting said control circuit to said first end of said upper flexible circuit board of said first bank and electrically connecting said second end of said upper flexible circuit board of said first bank to said first end of said lower flexible circuit board of said first bank; and attachment means placed on said attachment surface of said upper and lower flexible circuit boards of said first bank for releasable securement to wearing apparel.

2. The optical display device according to claim 1 wherein said first plurality of illumination means are further characterized as sixteen incandescent lamps located on said first bank.

3. The optical display device according to claim 1 wherein said control circuitry comprises an eight wire output to said first bank whereby four of said first plurality of illumination means of the first bank are serially connected.

4. The optical display device according to claim 1 further comprising a second bank of elongated rectilinearshaped flexible circuit boards, said second bank being separated from said first bank, and also having an upper flexible circuit board with a first end and a second end, said first bank also having a lower flexible circuit board with a first end and a second end, each of said upper and lower circuit boards having a connector surface and an attachment surface; said second end of said upper flexible circuit board of said second bank being spaced from said first end of said lower flexible circuit board of said second bank in order to provide a space therebetween which is to be associated with another articulated surface portion of a garment, or the like, to which said second bank is supported;

a second plurality of illumination means electrically connected on said connector surface of each of said upper and lower flexible circuit boards of said second bank;

another shield means coupling to said connector surface between said first and second ends of each of the upper and lower circuit boards of said second bank, said another shield means enshrouding said second plurality of illumination means for forming a barrier thereto;

said control circuit also energizing said second plurality of illumination means;

another connector means electrically connecting said control circuit to said first end of said upper flexible circuit board of said second bank and electrically connecting said second end of said upper flexible circuit board of said second bank to said first end of said lower flexible circuit board of said second bank; and another attachment means placed on said attachment surface of said upper and lower flexible circuit boards of said second bank for releasable securement to wearing apparel.

5. The optical display device according to claim 4 wherein said second bank is a mirror image of said first bank.

6. The optical display according to claim 1 wherein the free space between the first end and the second end of the connector side not occupied by said lamps is covered with adhesive material.

7. The optical display device according to claim 6 wherein said adhesive material has reflective characteristics.

8. The optical display device according to claim 1 wherein said shield means is made from a clear or colored translucent material.

9. The optical display device according to claim 1 wherein said control circuit is further characterized as a IC based circuit having continuous or an adjustable sequential/random flashing mode.

10. The optical display device according to claim 9 wherein said adjustable flashing mode is controlled by a manually adjustable potentiometer.

11. The optical display device according to claim 1 wherein said attachment means comprises an adhesive. placed on the attachment side of each of said circuit board for releasably securing to wearing apparel.

12. The optical display device according to claim 11 wherein said adhesive is further characterized as commercially available two side adhesive tape.

13. The optical display device according to claim 1 wherein said attachment means comprises a loop and pile arrangement for releasable securing components of said circuit boards, said power source, and said control circuitry.

14. The optical display device according to claim 1 wherein said attachment means comprises a plurality of cutouts throughout each of said circuit boards allowing for attachment by thread to the apparel.

15. The optical display device according to claim 1 wherein said control circuitry provides a two wire output to the first bank in a serial-parallel connection.

16. An optical display device for use on wearing apparel having articulating surfaces comprising:

a first bank of elongated flexible circuit boards, said first bank having an upper flexible circuit board with a first end and a second end, said first bank also having a lower flexible circuit board with a first end and a second end, said upper and lower circuit boards having a connector surface and an attachment surface;

a second bank of elongated flexible circuit boards, said second bank having an upper flexible circuit board with a first end and a second end, said second bank also having a lower flexible circuit board with a first end and a second end, said upper and lower circuit boards of said second bank having a connector surface and an attachment surface;

a plurality of lamps connected on said connector surface of each of said upper and lower circuit boards of said first and second banks;

shield means coupling to said connector surface between said first and second ends of each of the upper and lower circuit boards of said first and second banks, said shield means enshrouding said plurality of lamps forming a barrier thereto;

control circuitry for the energization of said lamps, said control circuitry being mounted on said first end of said upper and lower circuit boards of said first and second banks;

a power circuit having IC chip based timing circuit and a power source for illuminating said lamps;

a two wire connector means electrically connecting said power source to said control circuitry of said first end of said upper circuit board of said first bank and electrically connecting said second end of said upper control board of said first bank to said control circuitry of said lower circuit board of said first bank, and electrically connecting said power source to said control circuitry of said first end of said upper circuit board of said second bank and electrically connecting said second end of said upper control board of said second bank to said control circuitry of said lower circuit board of said second bank; and attachment means on said attachment surfaces of said upper and lower flexible circuit boards of said first and second banks and said power circuit for releasable securement to wearing apparel.

17. In a garment having articulating surface portions, and having an optical display device thereon, said optical display device comprising a plurality of illumination means, the improvement comprising:

said optical display device further comprising:

a first elongated flexible circuit board and a second elongated flexible circuit board to which said illumination means are electrically mounted, each said flexible circuit board having a plurality of conducting paths; said first flexible circuit board having a first end and a second end, and said second flexible circuit board having a first end and a second end; said second end of said first flexible circuit board being in close proximity to, and spaced from, said first end of said second flexible circuit board;

a control circuit electrically coupled to at least one of said first and second flexible circuit boards;

means for electrically coupling said control board to said at least one flexible circuit board; and flexible, articulatory, interconnecting means for electrically connecting said second end of said first flexible circuit board to said first end of said second flexible circuit board; said flexible, articulatory, interconnecting means being mounted on one said articulating surface portion of said garment, said first elongated flexible circuit board being mounted on said garment above said one articulating surface, and said second elongated flexible circuit board being mounted on said garment below said one articulating surface.

18. The improvement according to claim 17, wherein said flexible, articulatory, interconnecting means comprises an accordion-type electrical connector.

19. The improvement according to claim 17, wherein each said flexible circuit board comprises a cover means for covering said said illumination means mounted on each said board; said cover means comprising an elongated member extending along most of the length of the respective said flexible circuit board, and adhesive means for releasably mounting said elongated member to the respective said flexible circuit board.

20. The improvement according to claim 19, wherein said adhesive means comprises adhesive material covering the respective said flexible circuit board between the individual illumination means.

21. The improvement according to claim 20, wherein said adhesive means comprises reflective means for providing reflective characteristics.

22. The improvement according to claim 17, wherein said control circuit electrically coupled to at least one of said first and second flexible circuit boards comprises an IC based circuit having one of a continuous mode and adjustable sequential/random flashing mode.

* * * * *